United States Patent [19]

Davis

[11] Patent Number: 4,522,048

[45] Date of Patent: Jun. 11, 1985

[54] LOCK AND DOOR REINFORCING PLATE MEANS

[76] Inventor: Phillip N. Davis, 2723 S. Zunis St., Tulsa, Okla. 74114

[21] Appl. No.: 548,997

[22] Filed: Nov. 7, 1983

[51] Int. Cl.[3] ..... E05B 63/00

[52] U.S. Cl. ..... 70/417; 70/452; 70/381

[58] Field of Search ..... 70/417, 381, 452, 451, 70/416, 418, 451; 292/346

[56] References Cited

U.S. PATENT DOCUMENTS

| | | | |
|---|---|---|---|
| Re. 16,123 | 7/1925 | Schonwald | 70/417 |
| 4,466,264 | 8/1984 | de Nero | 70/417 |

FOREIGN PATENT DOCUMENTS

| | | | |
|---|---|---|---|
| 2916501 | 11/1980 | Fed. Rep. of Germany | 70/417 |
| 2402048 | 4/1979 | France | 70/417 |
| 2415184 | 8/1979 | France | 70/417 |
| 593407 | 11/1977 | Switzerland | 70/417 |

*Primary Examiner*—Robert L. Wolfe

*Attorney, Agent, or Firm*—Head, Johnson & Stevenson

[57] ABSTRACT

A lock and door reinforcing plate device comprising plate members adapted to be secured to the opposite faces of the door by common bolt members which extend through the plates and the door and the lock assembly, a tube member is secured to the inner face of one of the plate members and extend through the door for encasing the usual lock cylinder assembly, the lock cylinder assembly is secured to one of the plates and is disposed within the tube in a manner substantially precluding unauthorized tampering or removal of the lock cylinder assembly thus substantially precluding unauthorized unlocking of the lock assembly.

7 Claims, 4 Drawing Figures

LOCK AND DOOR REINFORCING PLATE MEANS

BACKGROUND OF THE INVENTION

1. Field of the Invention

This invention relates to improvements in locking devices and more particularly, but not by way of limitation, to a lock and door reinforcing plate means for providing a security lock for the door.

2. DESCRIPTION OF THE PRIOR ART

The increasing crime rate involving burglaries has increased the demand for locking devices providing greater security against unauthorized entry into the premises of a building, house, or the like. As a result, there has been activity in the field of locking devices to increase the difficulty of entry into or through a locked door. Some of the older devices are shown in the Patterson U.S. Pat. No. 364,850, issued June 14, 1887, entitled "Combined Key Hole Guide and Escutcheon;" Voight et al U.S. Pat. No. 897,803, issued Sept. 1, 1908, entitled "Lock Construction;" Tinnerman U.S. Pat. No. 2,443,362, issued June 15, 1948, entitled "Fastening Device;" and Clark U.S. Pat. No. 2,568,273, issued Sept. 18, 1951, entitled "Door Lock." More recent attempts to solve the problem of unauthorized entry through locked doors are shown in the Rutherford U.S. Pat. No. 3,513,674, issued May 26, 1970, entitled "Interchangeable Lock Casing;" Deahl U.S. Pat. No. 3,628,356, issued Dec. 21, 1971, entitled "Door Lock Protection Device;" Prahl U.S. Pat No. 3,899,907, issued Aug. 19, 1975, entitled "Cylinder Lock Assembly;" and the Nero U.S. Pat. No. 4,316,371, issued Feb. 23, 1982, entitled "High Safety Bolt Control Devices." Whereas these locking devices have been directed toward security locking of doors, and the like, they have certain disadvantages in that in some instances, the lock cylinder may be punched into or through the door, or pulled or pried out of the door thus removing the effectiveness of the lock. In other instances, the door skin surrounding or adjacent to the lock cylinder may be manually depressed by an intruder, thus creating a space behind the edge of the cylinder through which the intruder may reach and manipulate the lock cylinder tail piece or lock bolt mechanism to gain entry into the area behind the locked door. Some of the presently available safety lock devices include plate members which may be dislodged or removed forceably by an intruder to gain entrance through a locked door. The disadvantages of the present day locking devices will be readily apparent.

SUMMARY OF THE INVENTION

The present invention contemplates a novel lock and door reinforcing plate means particularly designed and constructed for overcoming the foregoing disadvantages. The novel lock and reinforcing plate means comprises a lock cylinder seated on a plate and secured thereto in a manner for resisting punching of the lock cylinder into or through a door. An escutcheon ring is welded or otherwise secured to the plate to prevent gripping of the lock cylinder for pulling or prying the lock cylinder out of the installed position in the door. A lock bore tube is disposed in substantially concentric relation with respect to the lock cylinder to prevent compressing of the skin of the door adjacent the lock and precluding access to the lock cylinder tail piece or lock bolt mechanism. In addition, the plate means is secured to the door by bolt members which extend completely through the door, thus preventing unauthorized dislodging of the plate disposed on the outside face of the door, and to hold the lock bolt mechanism or unit onto the inside face of the door. The novel lock and reinforcing plate means is simple and efficient in operation and economical and durable in construction.

DETAILED DESCRIPTION OF THE PREFERRED EMBODIMENT

Figure 1:
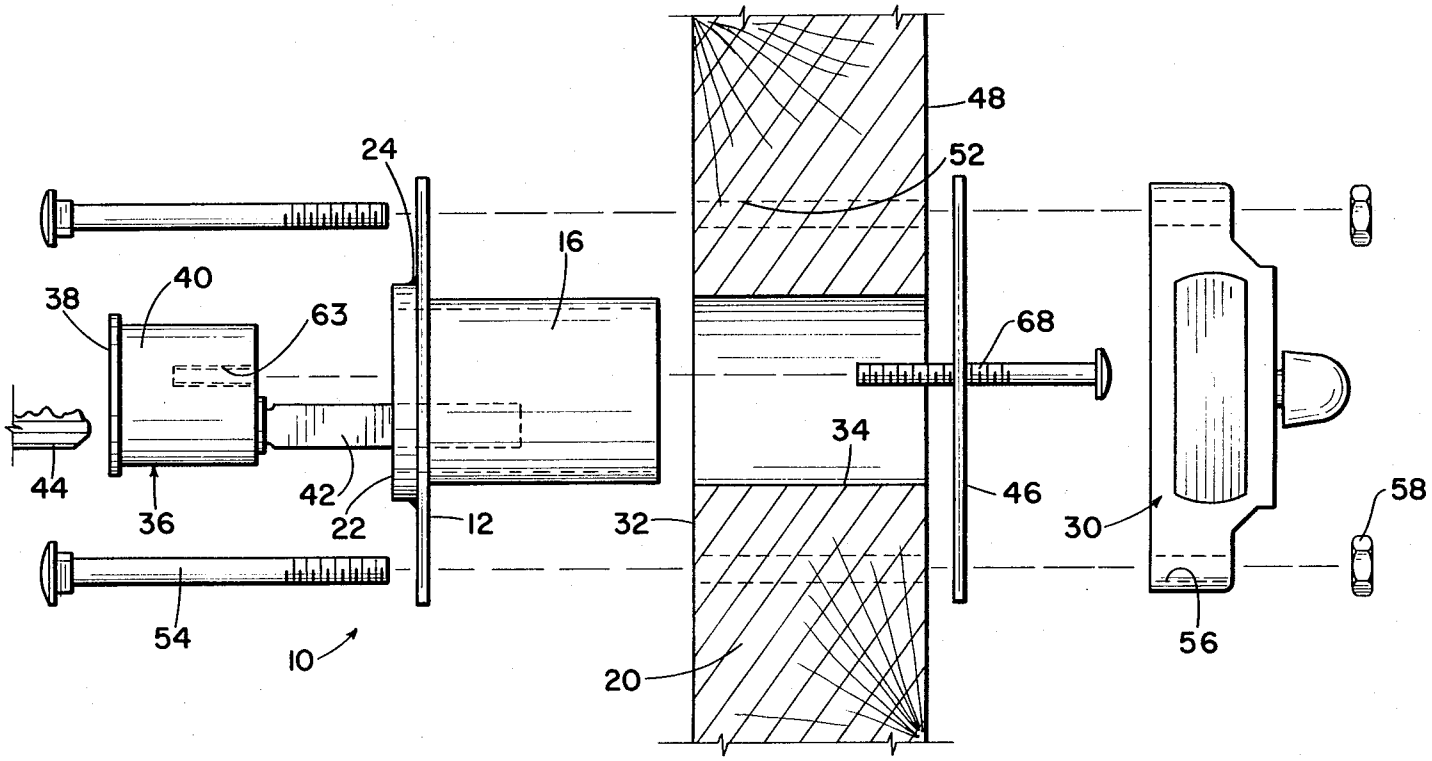
FIG. 1 is an exploded sectional elevational view of a lock and reinforcing plate means embodying the invention and illustrated for installation on a door.
Figure 2:
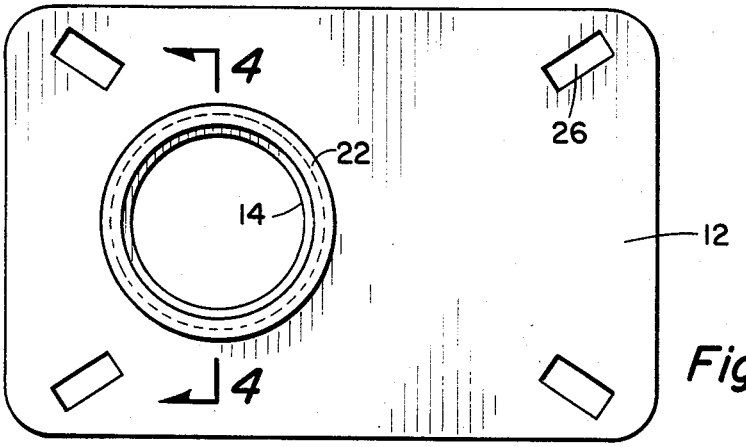
FIG. 2 is a front elevational view of a reinforcing plate means and lock bore tube as may be utilized in a lock and reinforcing plate means embodying the invention.
Figure 3:
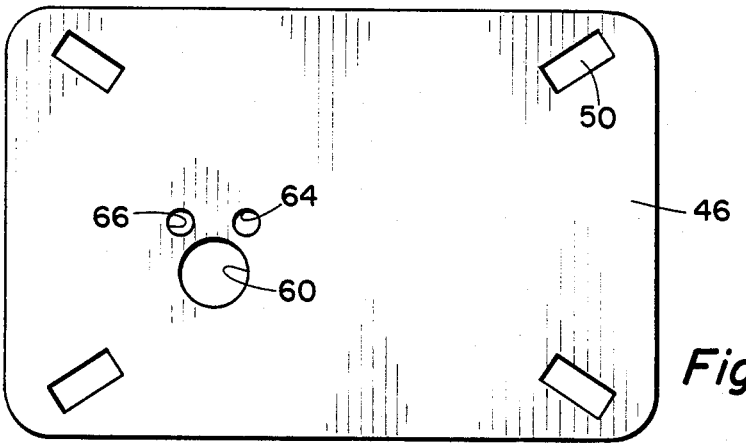
FIG. 3 is a front elevational view of a second plate means as may be utilized in a lock and reinforcing plate means embodying the invention.
Figure 4:
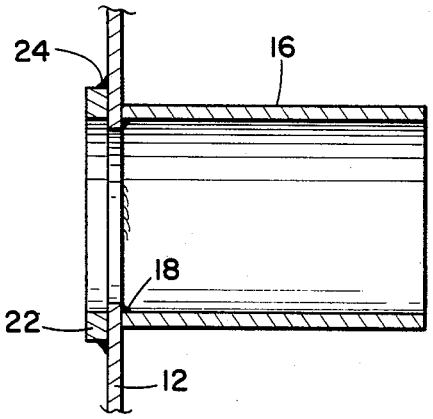
FIG. 4 is a sectional view taken on line 4—4 of FIG. 2.

Referring to the drawings in detail, reference numeral 10 generally indicates a lock and reinforcing plate means or device comprising a first plate member 12 having a bore 14 provided therein in substantial axial alignment with a lock bore tube means 16 which is secured to one face of the plate 12 in any suitable manner, such as by welding, or the like. The diameter of the bore 14 is preferably smaller than the inner diameter of the tube 16. It is preferably that the weld be placed around the inner periphery of the tube 16, as shown at 18 in FIG. 4 whereby access to the weld will be precluded upon the installation of the device 10, as will be hereinafter set forth. The tube 16 extends substantially perpendicularly outwardly with respect to the plane of the plate 12 and is preferably of a length corresponding to or substantially equal to the thickness of a door 20 with which the device 10 is to be utilized. An escutcheon ring 22 is welded or otherwise rigidly secured to the opposite face of the plate 12 with respect to the tube 16 and is concentrically disposed with respect to the bore 14 and tube 16. The inner diameter of the ring 22 is preferably substantially equal to the inner diameter of the tube 16, and the outer periphery of the ring 22 is welded or otherwise rigidly secured to the plate 12 as shown at 24 in FIG. 1. In addition, a plurality of spaced apertures 26 are provided in the plate 12. The apertures 26 are provided in the plate 12. The apertures 26 are preferably elongated, as particularly shown in FIG. 2, but not limited thereto. The elongated configuration of the apertures 26 facilitates the use of the device 10 with substantially any brand lock, such as the lock generally indicated at 30 in FIG. 1. It is preferably that the aperture 14 be position in the plate 12 in such a manner that one diameter of the aperture 14 is in substantial alignment with the horizontal centerline of the plate 12, as viewed in FIG. 2, but not limited thereto. When the aperture 14 is disposed along the horizontal centerline of the plate 12, the device 10 becomes substantially universal in that it may be utilized with either a left or right hand door.

The plate member 12 is adapted to be disposed against one surface or face 32 of the door 20, the face 32 normally being the outside of the door 20, but not limited thereto. The tube 16 extends longitudinally through a transversely extending bore 34 provided in the door 20. It is to be noted that the door 20 as shown herein is of a solid type construction. In the event the door 20 is of a hollow type construction, it is merely necessary to provide axially aligned bores (not shown) in the oppositely disposed faces or skins of the door in lieu of the bore 34, and the tube 16 may be inserted through the aligned bores during the installation of the device 10 on the door 20, as will be hereinafter set forth in detail. A lock cylinder assembly generally indicated at 36 may be installed in substantially concentric relation with respect to the tube 16. The lock cylinder assembly 36 may be of any suitable or standard rim cylinder type and normally includes a outwardly extending circumferential flange 38 which seats against the outer or exposed surface of the plate 12 when the cylinder element 40 of the lock 36 is disposed within the tube 16. The diameter of the bore 14 is preferably of a size corresponding to the outer diameter of the cylinder 40 for receiving the cylinder therethrough and permitting the circumferential flange 38 to seat or rest against the plate 12 surrounding the bore 14. The lock cylinder 36 also normally includes a tail piece assembly 42 which extends longitudinally outwardly from the inner end of the cylinder 40. The tail piece 42 extends through the tube 16 and into the normal or usual connection with the bolt 30 for actuation thereof as is well known. Of course, the tail piece assembly 42 is normally operably connected with an actuator (not shown) responsive to the proper key 44 for the opening of the lock 30 in the usual manner.

A second plate 46, preferably of a planar configuration corresponding to the planar configuration of the plate 12, but not limited thereto, is adapted to be positioned against the surface 48 of the door 20, the surface 48 normally being the inside of the door 20, but not limited thereto. The plate 46 is provided with a plurality of spaced apertures 50 adapted to be in alignment with the bores 26 of the plate 12 when the plate 46 is placed in position against the door surface 48. Bores 52 are provided in the door 20 extending between the aligned pairs of bores 26 and 50 of the plates 12 and 46 whereby bolt members 54 may be inserted through the respective aligned apertures 26, bores 52 and apertures 50 for securing the plates 12 and 46 in position against the opposite sides 32 and 48 of the door. In addition, the bolts 54 are sufficiently long as to extend through the complementary bores or apertures 56 of the lock assembly 30 for engagement by the lock nuts 58 whereby not only is the device 10 secured in position on the door 20, but also the lock assembly 30 is secured in operably connection therewith.

The plate member 46 is further provided with an aperture or bore 60 disposed in substantial alignment with the tail piece assembly 42 for receiving the assembly 42 therethrough in order that the tail piece may be operably engaged with the lock assembly 30 in the usual or well known manner. The usual lock cylinder assembly is provided with a longitudinally extending threaded bore 63 disposed in offset and substantially parallel relationship with the tail piece assembly 42. The plate 46 is provided with a pair of spaced apertures or bores 64 and 66, each of which is adapted to be positioned in alignment with the threaded bore 63, depending upon whether or not the plate 46 is installed for a left or right hand door. A bolt or screw means 68 may be inserted through the properly aligned bore 64 or 66 for threaded engagement with the bore 63 in order to secure the lock cylinder assembly 36 in against the plate 12 and within the tube 16. Of course, the screw means 68 is threadedly engaged with the bore 63 prior to the connection of the bolts 54 with the lock assembly 30. In this manner, the screw means 68 is concealed, thus rendering access to the lock cylinder assembly 30 very difficult if not impossible.

When the device 10 has been installed on the door 20, the lock cylinder assembly 36 is securely retained in position against unauthorized removal by virture of the fact that the circumferential flange 38 is disposed against the outer surface of the plate 12, which is preferably of a metallic construction. Thus, the surface area immediately surrounding the flange 38 cannot be compressed to permit a space for the prying loose of the lock cylinder 36. In addition, the inaccessibility of the screw means 68 further discourages any attempts at removal of the lock cylinder 36 from the device 10. The plate 12 is held securely in position against the outer surface 32 of the door 20 by the fact that the securing bolts 54 extend completely through the plate 12, door 20, plate 46 and lock assembly 30, thus rendering any prying of the plate essentially impossible. Even if the plate 12 were to be pryed away from the surface 32 the fact that the lock cylinder assembly 36 is encased within the tube 16 precludes access to the assembly 36. It will be readily apparent that the device 10 provides a secure means for the locking of a door against unauthorized entry.

From the foregoing it will be apparent that the present invention provides a novel lock and door reinforcing plate device having tube means surrounding the usual lock cylinder assembly, and having plate means secured to the opposite faces of the door in a manner substantially precluding unauthorized unlocking of the lock mounted within the interior of the door.

Whereas the present invention has been described in particular relation to the drawings attached hereto, it should be understood that other and further modifications, apart from those shown or suggested herein may be made within the spirit and scope of this invention.

What is claimed is:

1. A lock and reinforcing plate device for a door and comprising first and second plate means adapted to be disposed against the opposite faces of the door in substantial mutual alignment, tube means rigidly secured to the inner face of the first plate means and extending through the door in a direction toward the second plate means, an aperture provided in the first plate means in substantial axial alignment with the tube means, ring means rigidly secured to the outer face of the first plate means and concentrically arranged with respect to the tube means, lock cylinder means disposed against the outer face of the first plate means and extending into the interior of the tube means in a direction toward the second plate means, connection means extending through the second plate means and tube means for engagement with the lock cylinder means for securing the lock cylinder means in position, lock assembly means disposed adjacent the outer face of the second plate means, and in operable engagement with the lock cylinder means and securing means extending between the first and second plate means and through the door and lock assembly means for securing the device on the door.

2. A lock and reinforcing plate device as set forth in claim 1 wherein the diameter of the aperture is smaller than the inner diameter of the tube means whereby the tube means may be secured to the inner surface of the first plate means at the inner periphery of the tube means.

3. A lock and reinforcing plate device as set forth in claim 1 wherein the ring means is secured to the outer face of the first plate means around the outer periphery of the ring means.

4. A lock and reinforcing plate device as set forth in claim 1 wherein the connection means comprises threaded screw means extending through the second plate means and the interior of the tube means for threaded connection with the lock cylinder means.

5. A lock and reinforcing plate device as set forth in claim 1 wherein the securing means comprises at least one bolt means extending through the first and second plate means and the door and the lock assembly means, and lock nut means engagable with the outer end of the bolt means for locking the bolt means in position.

6. A lock and reinforcing plate device as set forth in claim 5 wherein the lock assembly means is disposed at the inner side of the door, and the lock nut means is disposed at the inner side of the door for precluding unauthorized access thereto.

7. A lock and reinforcing plate device as set forth in claim 1 wherein the inner diameter of the ring means is larger than the diameter of the aperture whereby the ring means is seated against the first plate means throughout its entire dimensions.

* * * * *